US008773283B2

(12) United States Patent
Shi et al.

(10) Patent No.: US 8,773,283 B2
(45) Date of Patent: Jul. 8, 2014

(54) ROAD TRAFFIC CONTROL SYSTEM

(75) Inventors: Zheng Shi, Shenzhen (CN); Jiang-Feng Liu, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 13/446,792

(22) Filed: Apr. 13, 2012

(65) Prior Publication Data

US 2013/0049990 A1 Feb. 28, 2013

(30) Foreign Application Priority Data

Aug. 25, 2011 (CN) ..... 2011 1 0246226

(51) Int. Cl.
*G08G 1/095* (2006.01)

(52) U.S. Cl.
USPC ..... 340/907; 340/928; 340/933; 340/936; 701/301; 701/117; 701/118; 701/119

(58) Field of Classification Search
USPC ..... 340/928, 933, 936; 701/301, 117, 118, 701/119
See application file for complete search history.

(56) References Cited

U.S. PATENT DOCUMENTS

| | | | | |
|---|---|---|---|---|
| 5,490,661 | A * | 2/1996 | Stevens et al. | 256/13.1 |
| 6,246,948 | B1 * | 6/2001 | Thakker | 701/93 |
| 6,539,175 | B1 * | 3/2003 | Geary et al. | 396/59 |
| 2005/0156757 | A1 * | 7/2005 | Garner | 340/907 |
| 2006/0269104 | A1 * | 11/2006 | Ciolli | 382/104 |
| 2007/0274158 | A1 * | 11/2007 | Agam et al. | 367/96 |
| 2008/0119965 | A1 * | 5/2008 | McCrary | 701/2 |
| 2009/0102699 | A1 * | 4/2009 | Behrens et al. | 342/109 |
| 2010/0128127 | A1 * | 5/2010 | Ciolli | 348/143 |

* cited by examiner

*Primary Examiner* — Daryl Pope
(74) *Attorney, Agent, or Firm* — Novak Druce Connolly Bove + Quigg LLP

(57) ABSTRACT

A road traffic control system is applied to an intersection to control traffic and includes a light support, three traffic lights, a bracket, a number of indicators and a light controller. The light support is installed at one side of one lane at the intersection; the traffic lights are fixed on the light support and above the lane. The bracket is installed at one side of another lane at the intersection, and a number of stop lines are formed on the lane. The indicators are fixed on the bracket and above the stop lines to control traffic. The light controller controls to synchronously turn on or off the plurality of indicators and the traffic lights, and the indicators emit the same color light as the traffic lights.

18 Claims, 2 Drawing Sheets

ROAD TRAFFIC CONTROL SYSTEM

BACKGROUND

1. Technical Field

The disclosure generally relates to a road traffic control system.

2. Description of the Related Art

With the rapid development of urbanization, traffic problems have become increasingly serious. For example, when a car drives behind a truck approaching an intersection, the driver in the car may not see the traffic lights at the intersection because the truck is blocking the traffic lights from line of sight, which may cause a traffic accident if the driver of the car is not careful.

Therefore, there is room for improvement within the art.

BRIEF DESCRIPTION OF THE DRAWINGS

Many aspects of a road traffic control system can be better understood with reference to the following drawings. The components in the drawings are not necessarily drawn to scale, the emphasis instead being placed upon clearly illustrating the principles of the road traffic control system. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
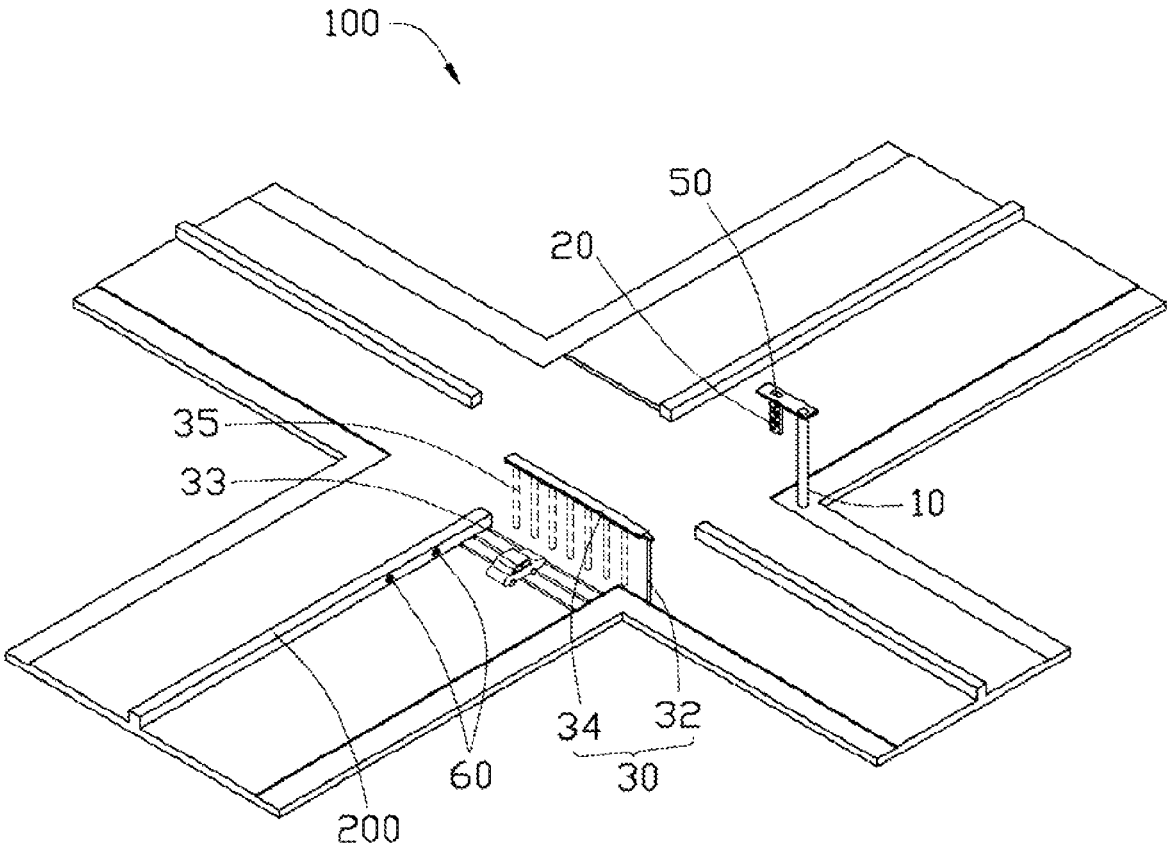
FIG. 1 is a schematic view of one embodiment of a road traffic control system applied to a road of the disclosure.

FIG. 1 is a schematic view of one embodiment of a road traffic control system 100 applied to a road of the disclosure. In this embodiment, the road traffic control system 100 is used at an intersection to control and manage traffic; a number of guardrails 200 are positioned on the road in a row to divide the road into different lanes.

Figure 2:
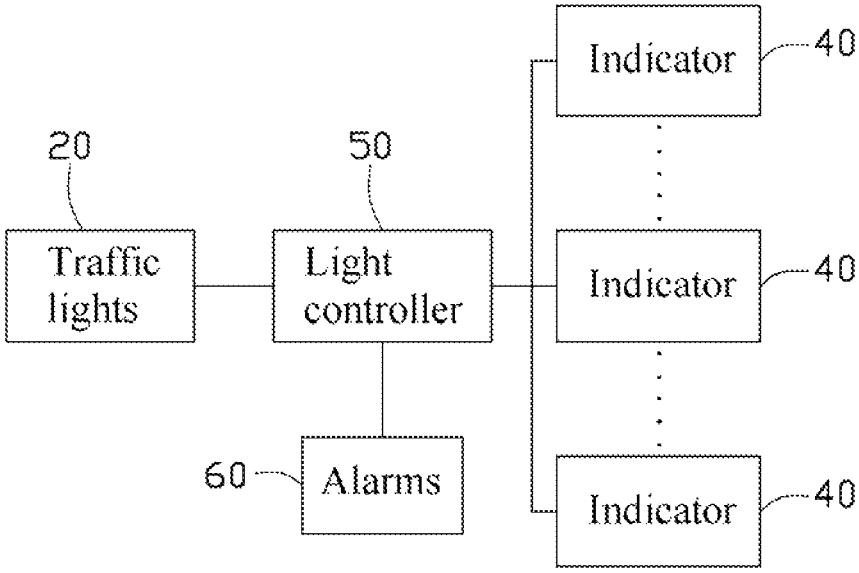
FIG. 2 is a block view of the road traffic control system shown in FIG. 1 of the disclosure.

Also referring to FIG. 2, the road traffic control system 100 includes a light support 10, three traffic lights 20, a bracket 30, a plurality of indicators 40, a light controller 50, and a plurality of alarms 60. The light support 10 is installed at the edge of one side of one lane. The traffic lights 20 are installed on the light support 10 and are positioned above the lane at road intersection to control traffic. The traffic lights 20 alternate the priority (right of way) of road users by displaying lights of a standard color (e.g., yellow, red, and green) under the control of the light controller 50 to warn the pedestrians and drivers.

The bracket 30 includes a support frame 32 and a beam 34. The support frame 32 is vertically installed at the edge of one side of another lane which includes a plurality of stop lines on the surface of the lane. The beam 34 is vertically fixed at the top end of the support frame 32 and is substantially aligned with a first stop line 33 on the lane in parallel. The indicators 40 can be light emitting diodes (LEDs) and are installed at the beam 34 above the first stop line 33. The light controller 50 controls the indicators 40 to emit red, yellow or green light perpendicular towards the lane, forming a light beam 35.

The light controller 50 can be installed on the light support 10 or the bracket 30. In this embodiment, the light controller 50 is positioned on the light support 10 and is electrically connected to the traffic lights 20 and the indicators 40. The light controller 50 controls the turning on or off the traffic lights 20 and the indicators 40 synchronously. For example, when the light controller 50 controls the traffic lights 20 to emit red light, the light controller 50 then controls the indicators 40 to emit red light at the same time.

In this embodiment, the light controller 50 can control the indicators 40 to emit red, yellow or green light by adjusting and controlling the current flowing through the indicators 40. For example, when the current flowing through the indicators 40 is about 10 mA, the indicators then 40 emit red light; when the current of the indicators 40 is about 15 mA, the light controller 50 then controls the indicators 40 to emit yellow light; when the current flowing through the indicators 40 is about 20 mA, the light controller 50 then controls the indicators 40 to emit green light.

The alarms 60 are positioned on the guardrails 200 and electrically connected to the light controller 50. When the traffic lights 20 are changed to yellow or red color, the light controller 50 sends a command signal to the alarms 60 to activate and enable the alarms 60 to output warning signals. In this embodiment, the number of the alarms 60 is two, one alarm 60 is about 10 meters away from the first stop line 33, and the other alarm 60 is about 20 meters away from the first stop line 33.

When a car drives to the intersection and the driver of the car cannot see the traffic lights 20 due to the line of sight being blocked by other vehicles. If the traffic lights 20 emit red light, the light controller 50 controls the indicators 40 to emit red light to form a red light beam to remind the driver of car to promptly slow down or stop. On the other hand, when the traffic lights 20 are changed to red light, the light controller 50 sends a command signal to the alarms 60 to enable and activate the alarms 60 to output warning signals to alert the driver to slow down or stop in time.

In summary, in the road traffic control system 100 of the disclosure, the plurality of indicators 40 are installed above the stop lines of the lane, and the light controller 50 synchronously controls to turn on or off the indicators 40 and the traffic lights 20. Thus, even through the traffic lights 20 are blocked from line of sight, the indicators 40 can still provide the same color lights as the traffic lights 20 for the drivers. Furthermore, the light controller 50 can control the alarms 60 to output warning signals to alert the driver of the car to slow down or stop in time to avoid traffic violations or accidents.

In the present specification and claims, the word "a" or "an" preceding an element does not exclude the presence of a plurality of such elements. Further, the word "comprising" does not exclude the presence of elements or steps other than those listed.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in the matters of shape, size, and arrangement of parts within the principles of this exemplary disclosure to the full extent indicated by the broad general meaning of the terms in which the appended claims are expressed.

What is claimed is:

1. A road traffic control system comprising:

three traffic lights installed above one lane at a road intersection;

a plurality of indicators installed above another lane at the road intersection;

a light controller electrically connected to the traffic lights and the plurality of indicators, wherein the light controller synchronously controls the traffic lights and the plurality of indicators to emit the same color of light; and a plurality of alarms positioned on a guardrail and electrically connected to the light controller;

wherein when the traffic lights are changed to yellow or red color, the light controller sends a command signal to the alarms to activate and enable the alarms to output warning signals to alert the driver to slow down or stop in time.

2. The road traffic control system as claimed in claim 1, further comprising a light support, wherein the light support is installed at the edge of one side of one lane, the traffic lights are installed on the light support and are positioned above the lane at road intersection to control traffic, and the traffic lights alternate the priority of road users by displaying lights of a standard color under the control of the light controller to warn drivers and pedestrians.

3. The road traffic control system as claimed in claim 1, further comprising a bracket, wherein the bracket comprises a support frame, the support frame is vertically installed at the edge of one side of another lane, and the lane comprise a plurality of stop lines on the surface of the lane.

4. The road traffic control system as claimed in claim 3, wherein the bracket further comprises a beam, and the beam is vertically fixed at the top end of the support frame and is substantially aligned with a first stop line on the lane in parallel.

5. The road traffic control system as claimed in claim 4, wherein the plurality of indicators are light emitting lights and are installed at the beam above the first stop line.

6. The road traffic control system as claimed in claim 1, wherein the light controller controls the plurality of indicators to emit different colors of light perpendicular towards the lane by controlling the current flowing through the plurality of indicators, and the light of the plurality of indicators forms a light beam vertically towards to lane.

7. The road traffic control system as claimed in claim 2, wherein the light controller is positioned on the light support, and controls to turn on or off the traffic lights and the indicators synchronously, when the light controller controls the traffic lights to emit red, yellow or green light, the light controller controls the indicators to emit red, yellow or green light at the same time.

8. The road traffic control system as claimed in claim 7, wherein when the current flowing through the indicators is 10 mA, the plurality of indicators emit red light; when the current of the plurality of indicators is 15 mA, the light controller controls the plurality of indicators to emit yellow light; when the current flowing through the plurality of indicators is 20 mA, the light controller controls the indicators to emit green light.

9. The road traffic control system as claimed in claim 4, further comprising two alarms positioned on a guardrail and electrically connected to the light controller, wherein one alarm is 10 meters away from the first stop line, and the other alarm is 20 meters away from the first stop line.

10. A road traffic control system applied to an intersection to control traffic, the road traffic control system comprising:

a light support installed at one side of one lane at the intersection;

three traffic lights fixed on the light support and located above the lane to control traffic;

a bracket installed at one side of another lane at the intersection, the lane includes a plurality of stop lines;

a plurality of indicators fixed on the bracket and positioned above the stop lines of the lane to control traffic;

a light controller electrically connected to the plurality of indicators and the traffic lights, wherein the light controller controls to turn on or off the plurality of indicators and the traffic lights synchronously, and the plurality of indicators emit the same color light with the traffic lights according to road condition; and a plurality of alarms positioned on a guardrail and electrically connected to the light controller;

wherein when the traffic lights are changed to yellow or red color, the light controller sends a command signal to the alarms to activate and enable the alarms to output warning signals to alert the driver to slow down or stop in time.

11. The road traffic control system as claimed in claim 10, wherein the traffic lights are installed on the light support and are positioned above the lane at the intersection to control traffic, and the traffic lights alternate the priority of road users by displaying lights of a standard color under the control of the light controller to warn drivers and pedestrians.

12. The road traffic control system as claimed in claim 10, wherein the bracket comprises a support frame, the support frame is vertically installed at the edge of one side of another lane, and the lane comprise a plurality of stop lines on the surface of the lane.

13. The road traffic control system as claimed in claim 12, wherein the bracket further comprises a beam, and the beam is vertically fixed at the top end of the support frame and is substantially aligned with a first stop line on the lane in parallel.

14. The road traffic control system as claimed in claim 13, wherein the plurality of indicators are light emitting lights and are installed at the beam above the first stop line.

15. The road traffic control system as claimed in claim 10, wherein the light controller controls the plurality of indicators to emit different colors of light perpendicular towards the lane by adjusting the current flowing through the indicators, and the light of the plurality of indicators forms a light beam vertically towards to lane.

16. The road traffic control system as claimed in claim 10, wherein the light controller is positioned on the light support, and controls to turn on or off the traffic lights and the indicators synchronously, when the light controller controls the traffic lights to emit red, yellow or green light, the light controller controls the indicators to emit red, yellow or green light at the same time.

17. The road traffic control system as claimed in claim 10, wherein when the current flowing through the indicators is 10 mA, the plurality of indicators emit red light; when the current of the plurality of indicators is 15 mA, the light controller controls the plurality of indicators to emit yellow light; when the current flowing through the plurality of indicators is 20 mA, the light controller controls the indicators to emit green light.

18. The road traffic control system as claimed in claim 13, further comprising two alarms positioned on a guardrail and electrically connected to the light controller, wherein one alarm is 10 meters away from the first stop line, and the other alarm is 20 meters away from the first stop line.

* * * * *